US005385021A

United States Patent [19]

Beale

[11] Patent Number: 5,385,021

[45] Date of Patent: Jan. 31, 1995

[54] FREE PISTON STIRLING MACHINE HAVING VARIABLE SPRING BETWEEN DISPLACER AND PISTON FOR POWER CONTROL AND STROKE LIMITING

[75] Inventor: William T. Beale, Athens, Ohio

[73] Assignee: Sunpower, Inc., Athens, Ohio

[21] Appl. No.: 932,686

[22] Filed: Aug. 20, 1992

[51] Int. Cl.[6] ..... F25B 9/00

[52] U.S. Cl. ..... 62/6; 60/520

[58] Field of Search ..... 62/6; 60/520; 267/140.14, 140.15; 188/267; 92/84, 168

[56] References Cited

U.S. PATENT DOCUMENTS

| | | | |
|---|---|---|---|
| 3,991,586 | 11/1976 | Acord | 62/6 |
| 4,350,012 | 9/1982 | Folsom et al. | 62/6 |
| 4,610,143 | 9/1986 | Stolfi et al. | 62/6 |
| 4,783,968 | 11/1988 | Higham et al. | 62/6 |
| 4,819,439 | 4/1989 | Higham | 62/6 |
| 4,822,390 | 4/1989 | Kazumoto et al. | 62/6 |
| 4,872,313 | 10/1989 | Kazumoto et al. | 62/6 |
| 4,912,929 | 4/1990 | Chen et al. | 62/6 |
| 5,022,229 | 6/1991 | Vitale | 62/6 |
| 5,032,772 | 7/1991 | Gully et al. | 62/6 |
| 5,088,288 | 2/1992 | Katagishi et al. | 62/6 |
| 5,090,206 | 2/1992 | Strasser | 62/6 |
| 5,113,662 | 5/1992 | Fujii et al. | 62/6 |
| 5,177,971 | 1/1993 | Kiyota | 62/6 |

*Primary Examiner*—Ronald C. Capossela
*Attorney, Agent, or Firm*—Frank H. Foster

[57] ABSTRACT

Free piston Stirling coolers and engines are improved by a spring coupling the displacer to the piston and having a variable spring constant. Controllable variation of its spring constant permits controllable variation of displacer stroke, engine power output and cooler thermal pumping rate and thus the invention is useful for stroke limiting and load matching.

9 Claims, 2 Drawing Sheets

FREE PISTON STIRLING MACHINE HAVING VARIABLE SPRING BETWEEN DISPLACER AND PISTON FOR POWER CONTROL AND STROKE LIMITING

TECHNICAL FIELD

This invention relates to the field of free piston Stirling engines and coolers, broadly termed Stirling cycle thermomechanical transducers. The invention is more specifically directed to power control and stroke limiting for Stirling cycle thermomechanical transducers.

BACKGROUND ART

Free piston Stirling engines usually drive a mechanical load such as a pump or an electrical alternator. Free piston Stirling coolers are usually driven by an electric motor or the like to transfer heat from one place to another, for example from the inside to the outside of a freezer cabinet. Due to fluctuations in load power demands for engines and heat transfer demands for coolers, the Stirling machine must have a power control to match the engine's output or the cooler's thermal transport to the needs of the system with which the machine is cooperating. For example, a free piston Stirling engine driving a load which decreases or increases its power demand at some time, such as an electrical alternator, must increase or decrease engine power output accordingly.

An associated problem occurs if the load on an engine decreases or cooler thermal transport demand decreases because the amplitude of oscillation of the displacer and piston may increase beyond desirable limits, causing collision of internal engine parts and possible damage. Such overstroke results because the energy input to the engine equals the sum of the energy output and the energy losses of the engine. When a load demand decreases, the excess energy no longer coupled to the load tends to drive the displacer to higher amplitude, usually beyond the maximum desired amplitude and can result in a runaway condition. Therefore, it is additionally desirable to limit the amplitude of oscillation of the displacer and piston in the event of a substantial decrease in load demand.

There is, therefore, a need for a means for controlling the power output and limiting the amplitude of a free piston Stirling engine and controlling the thermal transport of a free piston Stirling cooler.

BRIEF DISCLOSURE OF INVENTION

This invention is an improvement in a Stirling cycle thermomechanical transducer of the type having a power piston and a displacer piston which reciprocate freely within a housing. The improvement comprises a spring means, having a variable spring constant and a spring deflection proportional to the relative displacement between the displacer piston and the power piston. Controlled variation of the spring constant controllably varies the ratio of power piston amplitude to displacer piston amplitude and also changes their relative phase of their displacement. This in turn allows direct controllable variation of engine power or thermal transport by controllably varying the spring constant of the spring.

This spring couples power from the displacer to the piston. As the spring is made stiffer, that is a higher spring constant K, the proportion of displacer power which is coupled from the displacer to the piston is increased. As a result, the increased stiffness leaves less power to displace the displacer, thereby reducing its amplitude (i.e. its maximum displacement) and therefore in turn reducing power to the piston because the displacer then moves a smaller fraction of the working gas between the hot and cold spaces. At the same time, the relative spring between displacer and piston changes the equivalent resonant spring constant on the displacer and piston so as to reduce the displacer phase lead over the piston, and this also reduces cycle power.

Power control or thermal transport control is accomplished by varying the spring constant as a function of load demand, either manually or automatically by a control system. For example, a reduced load demand may be detected and through a control system increase the spring stiffness sufficiently to cause an equal reduction in engine power output. In a Stirling cooler or heat pump the spring constant may be made stiffer to reduce the thermal pumping rate and thereby prevent excessive cooling.

While the usual way of reducing the thermal pumping rate of a cooler is simply to drive it less (i.e., reduce input voltage to the electric motor driving the cooler) the spring constant variation method of the invention would be useful where the piston amplitude is fixed or there is some other limitation on conventional heat pump power controls.

Stroke limiting may be accomplished by varying the spring constant as a function of piston or displacer displacement so that the spring constant is increased as the amplitude of oscillation approaches a design limit amplitude.

Figure 1:
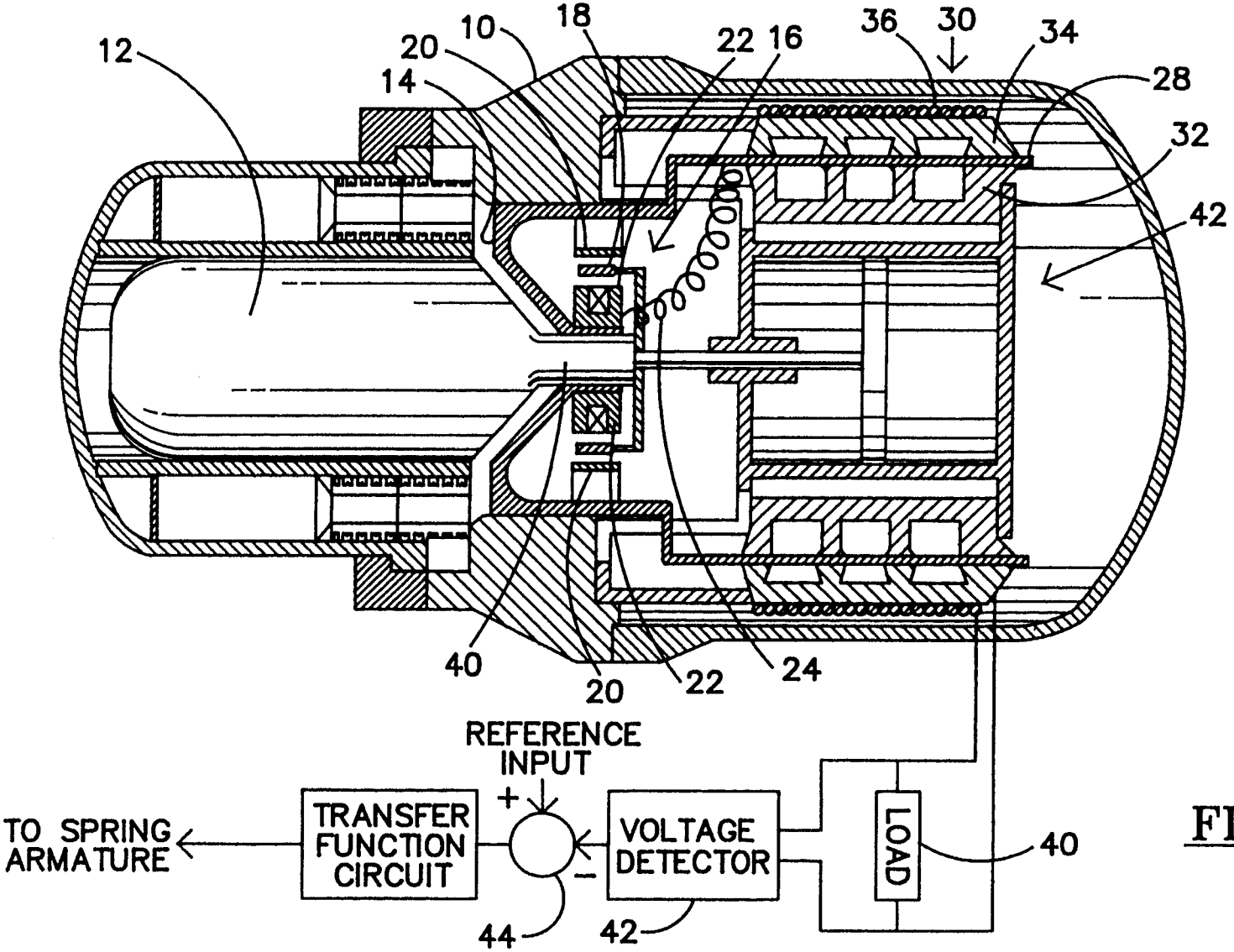
FIG. 1 is a side view in section of a preferred embodiment of the present invention illustrating a 300 watt engine with a variable electromagnet spring for obtaining the control.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the present invention is diagrammatically illustrated in FIG. 1, which shows a free piston Stirling engine 10 having a displacer 12, a piston 14 and an electromagnetically actuated spring 16 between them.

This embodiment of a variable spring is the equivalent of a conventional linear motor between the displacer 12 and the piston 14, in which the moving magnet 18 is attached to the displacer 12, and the flux path 20 and armature winding 22 are attached to the piston 14. Such a linear motor can be made to have a very low power factor by making the armature inductance large, so that when the armature current is flowing, the alternator has a very low power factor, and the force on the magnet lags the armature voltage a large fraction of 90 degrees. Therefore, the forces are nearly in the same phase relation as those of a relative mechanical spring i.e., almost in proportion to the relative displacement between displacer and piston. This relative spring can be varied in stiffness by controlling the armature current, with the higher current causing a higher spring constant. This current can be controlled by conventional current control circuits so as to result in the desired engine power at any piston stroke.

In this embodiment, the magnet on the alternator will also operate as a spring even without the armature current. This spring is slightly negative at low relative strokes, and becomes strongly positive as the magnet begins to move out of the flux path. This results in power flow from the piston to the displacer at low relative amplitudes, and power flow from displacer to piston at high amplitudes, and serves therefor the useful effect of limiting displacer relative amplitude. The electromagnetic spring can also be designed so there is no spring effect from the magnet motion only, but only spring effect from armature current.

The electromagnet control current for controllably varying the spring constant of the electromagnetic spring 16 is fed from a wire 24 attached to the casing of the machine and supported by a flexing member to the electromagnet. The stiffness of such an electromagnetic spring is proportional to the current through its coil, as is well known. When, for example, coil current is increased, the spring constant K, is increased. Therefore more energy is coupled from the displacer 12 to the piston 14. As more energy is coupled from the displacer 12 to the piston 14, less energy is available to drive the displacer 12. Therefore, the amplitude of the displacer 12 decreases and it displaces less working gas. As less working gas is displaced by the displacer 12, less working gas is moved between the expansion and compression spaces of the Stirling engine 10, and therefore less work is done during expansion and compression of the working gas. Since the working gas drives the piston 14, less work done by the working gas means that less work is done on the piston 14 and therefore less power is produced by the Stirling engine 10.

Thus, in the embodiment of FIG. 1, when the engine power output is too great, increasing the current to the electromagnet will increase the stiffness of the spring coupling the piston 14 to the displacer 12. This causes more energy to be coupled from the displacer 12 to the piston 14 which causes a decrease in power output as described above.

By varying the stiffness of the spring, engine power output and displacer amplitude are varied. The variation in the stiffness can be intended to accomplish only one of these two purposes, power or stroke control, but the second of the two results will simultaneously also occur due to the variation in stiffness.

In the embodiment of FIG. 1 the piston 14 drives the permanent magnets 28 of an electrical power generating linear alternator 30. The permanent magnet reciprocate between pole pieces 32 and 34 upon which an armature 36 is wound. This alternator 30 in the illustrated embodiment forms no part of the invention. FIG. 1 also illustrates a displacer connecting rod 40 connecting the displacer to a gas spring fixedly mounted in the housing of the engine 10, interiorly of the alternator 30 for conventional purposes.

Other embodiments will be apparent to those skilled in the art for more gradually increasing the spring constant as a continuous increasing function of displacer or piston displacement.

Instead of varying spring constant K as a function of displacer or piston amplitude, the stiffness or spring constant of the spring coupling the displacer to the piston may be controlled by a negative feedback control system or an "intelligent" computer controlled system which monitors the operation of the machine and varies spring stiffness to change the operation of the machine. For example, a human operator may monitor the machine and manually vary the spring constant. Alternatively, a feedback control system may be implemented which includes a computerized logic apparatus for monitoring the machine and automatically varying the stiffness of the spring.

Figure 4:
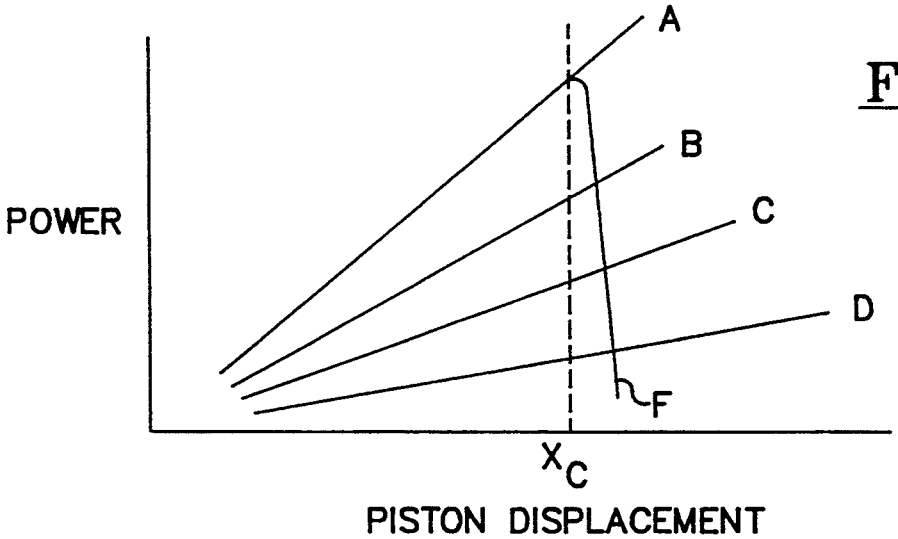
FIG. 4 is a graphical illustration of power versus piston amplitude for different control spring constants.

FIG. 4 is a graphical illustration of a family of curves of power versus piston displacement for typical Stirling cycle machines. Each of the curves A, B, C, D and E represent a different control spring constant and therefore a different displacer amplitude ratio. The amplitude ratio is defined as the ratio of piston displacement to displacer displacement, $X_p/X_d$ and is a decreasing function of the control spring constant K, that is, as K increases, the amplitude ratio decreases. In the graph of FIG. 4 the curves have an increasing spring constant in order with $K_A$ being the smallest spring constant and $K_D$ the largest.

Typically, a free piston Stirling engine is started with the minimum spring constant $K_A$ and would therefore operate along curve A. As piston amplitude increases, the power output increases correspondingly and the values will follow the curve A. Amplitude $X_c$ is a selected critical amplitude near which the piston operates in normal maximum power output operation. It is desirable that the amplitude of the piston be limited as it extends beyond displacement $X_c$.

If the spring constant is increased to $K_B$, the engine will operate on curve B and further increases in the spring constant will move engine operation onto curves C through D progressively. If the spring constant is increased from $K_A$ to $K_D$ as a function of amplitude or in response to a decreasing load power demand, machine operation will be along curve F.

The curve F is shown on the graph of FIG. 4 as the likely continuous path that the power versus piston displacement curve will follow when applied to the present invention. As the piston or displacer amplitude increases, if it exceeds a certain value, such as $X_c$, then the amplitude ratio can be adjusted by adjusting the K value and thereby causing the power output to decrease. The increase in piston amplitude is thereby greatly reduced. This is done by increasing the spring constant K, which causes more energy to be coupled from the displacer to the piston, as described above.

FIG. 1 also diagrammatically illustrates a simple control system as an example of the kind of feedback control system which might be utilized with the present invention. The output of the alternator 30 is applied in the conventional manner to a load 40. A voltage detector 42 detects the alternator output voltage and its output signal is applied along with a reference input signal to a summing junction 44. Consequently, the output of the summing junction 44 represents the error or difference between the desired output voltage and the reference input. The error signal from the summing junction 44 is applied through a high gain transfer function circuit to the armature of the magnetic spring 16 to vary its spring constant and maintain a nearly constant output voltage.

This invention may also be used on Stirling cycle coolers to vary the thermal energy transported in an analogous manner. Increasing the spring constant decreases thermal transport to change the cooling effect for a given piston stroke.

Once the principles of the present invention are understood for varying the spring constant in order to control power or thermal transport or to limit piston or displacer amplitude, many different types of systems for varying the spring constant will be apparent to those skilled in the art or will become apparent in the future. For example, the springs may be gas or magnetic or combinations, including combinations of mechanical and electromagnetic springs. The spring constant of gas springs may be varied by variations in the pressure of the gas spring. A variety of mechanical structures may also be created for varying the volume of the gas spring and for varying the pressure of the gas spring by pumping gas into and out of the gas spring chamber.

Figure 2:
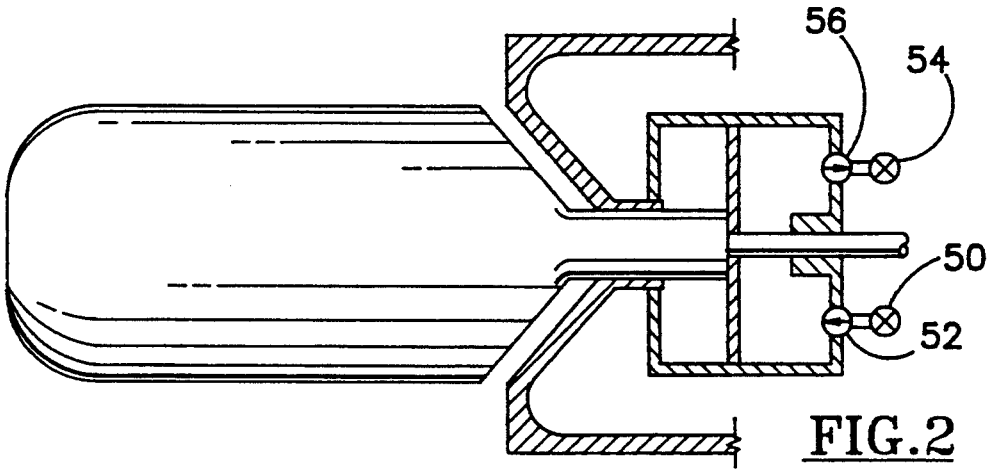
FIG. 2 is a side view in section of an alternative embodiment of the present invention using a variable gas spring.
Figure 3:
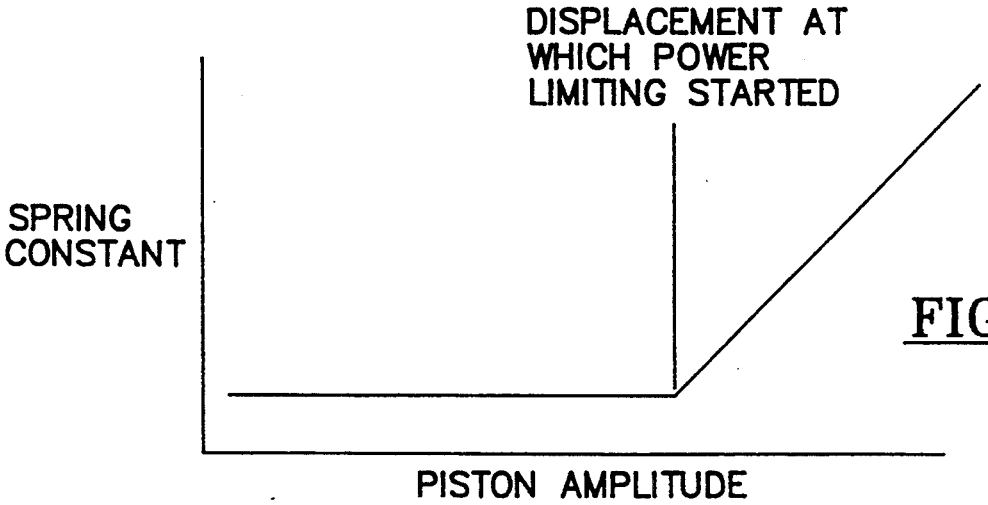
FIG. 3 is a graphical illustration of spring constant versus amplitude of the embodiment of FIG. 1.

FIG. 2 illustrates such a gas spring which is an alternative substitute for the magnetic spring illustrated in FIG. 1. The particular embodiment shown in FIG. 2 uses a solenoid valve 50 in series with a check valve 52 for allowing a flow of gas into the gas spring during its low portion of pressure cycle, and a solenoid 54 in series with a check valve 56 to allow a flow out of the spring during the high pressure portion of its cycle. Thus the spring constant, or pressure, is changed at will by actuating one or the other of the solenoid valves by way of an electric signal for the control system.

Similarly, a variety of systems for making the spring inherently nonlinear will also be apparent, because the nonlinear characteristics of gas and other springs are understood.

Further, a great variety of means for detecting power or stroke may will also be apparent to those skilled in the art, along with a substantial variety of control systems for utilizing a detected power or stroke signal to generate a control signal for varying the spring constant. However, since this invention is principally the discovery that a spring between the displacer and piston of a free piston Stirling engine or cooler may be controllably varied in order to control the rate at which work is done by the free piston Stirling machine, that is power out or thermal transport, rather than transducing technology or control system technology, further of these examples are not provided.

These explicit examples should not be interpreted to reduce the generality of the basic invention, which is a variable spring of any sort- electrical, mechanical pneumatic or other- which can be varied to control displacer amplitude and phase so as to control power output of the stirling cycle.

While certain preferred embodiments of the present invention have been disclosed in detail, it is to be understood that various modifications may be adopted without departing from the spirit of the invention or scope of the following claims.

I claim:

1. An improved Stirling cycle thermomechanical transducer having a displacer piston and a power piston reciprocating within a housing, the improvement comprising a spring having a variable spring constant and mechanically coupling the displacer piston to the power piston.

2. An improved Stirling cycle thermomechanical transducer in accordance with claim 1 further comprising a control system for varying the spring constant as an increasing function of load power demand.

3. An improved Stirling cycle thermomechanical transducer in accordance with claim 2 wherein the control system comprises a negative feedback control system.

4. An improved Stirling cycle thermomechanical transducer in accordance with claim 1 wherein the spring comprises:

an electromagnetically actuated spring.

5. An improved Stirling cycle cooler having a displacer and a piston reciprocating within a housing, the improvement comprising a spring, having a variable spring constant and mechanically coupling the displacer piston to the power piston.

6. A method for controllably varying the relative amplitudes of oscillation of the displacer and piston of a free-piston Stirling thermomechanical transducer having a spring mechanically linking the displacer and piston, the method comprising controllably varying the spring constant of said spring.

7. A method in accordance with claim 6 wherein said spring constant is increased as a function of piston amplitude to limit the amplitude of said displacer.

8. A method in accordance with claim 6 wherein the spring constant is varied as an increasing function of load voltage.

9. A method in accordance with claim 6 wherein the spring constant is varied as a decreasing function of thermal transport demand.

* * * * *